US006359427B1

(12) United States Patent
Edwards et al.

(10) Patent No.: US 6,359,427 B1
(45) Date of Patent: Mar. 19, 2002

(54) LINEAR REGULATORS WITH LOW DROPOUT AND HIGH LINE REGULATION

(75) Inventors: Christopher F. Edwards, Sunnyvale; J. William Maney, Emerald Hills, both of CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/632,724

(22) Filed: Aug. 4, 2000

(51) Int. Cl.[7] ..... G05F 3/16

(52) U.S. Cl. ..... 323/316

(58) Field of Search ..... 323/311, 312, 323/315, 316, 280, 273

(56) References Cited

U.S. PATENT DOCUMENTS 6,057,727 A * 5/2000 Dautriche et al. ..... 327/543

* cited by examiner

*Primary Examiner*—Peter S. Wong
*Assistant Examiner*—Gary L. Laxton
(74) *Attorney, Agent, or Firm*—Blakely, Sokoloff, Taylor & Zafman LLP

(57) ABSTRACT

Apparatus and method to provide high line regulation, which can be combined with a low dropout voltage, for linear regulators. The control for the regulators is referenced to ground rather than a relatively noisy power supply terminal so that the control is substantially free of power supply noise. The pass transistor forms the second transistor of a current mirror mirroring the current from the control. Referencing the control to ground and mirroring the control current to the pass transistor makes the output of the regulator substantially independent of the power supply noise. Various embodiments are disclosed.

18 Claims, 7 Drawing Sheets

LINEAR REGULATORS WITH LOW DROPOUT AND HIGH LINE REGULATION

BACKGROUND OF THE INVENTION

1. Field of the Invention

The present invention relates generally to regulator circuits, and more specifically, to linear regulator circuits.

2. Background Information

There are many circuit applications that require linear regulators that are minimally degraded by noise on the power supply. Examples of these applications include high quality signal processing, signal conditioning, laptop/notebook computers, cell phones and portable headphone speaker drivers. These applications require analog circuits that exist on the same printed circuit board (PCB) as other high speed/high power circuitry and, often, very noisy switch-mode power supplies. These high speed/high power circuits tend to corrupt the power supply voltage, resulting in poor analog circuit performance. In a typical low dropout regulator design, the power supply noise appears directly at the gate or base of the pass device, since the pass device is a P-channel or PNP device whose gate or base bias is referred to the unregulated supply voltage. Such a prior art circuit using a p-channel pass transistor is shown in FIG. 1. It may be seen therein that in the first instance, the noise on the power supply Vdd appears as a gate-source voltage noise, requiring the error amplifier to respond for any control of the effect of this noise. Hence the overall line regulation is determined by the gain of the error amplifier, which may be as low as 40 dB in order to maintain system stability. Therefore there is a need to have a regulator that not only has a low dropout voltage, but also good overall line regulation.

SUMMARY OF THE INVENTION

Apparatus and methods to provide high line regulation, which can be combined with a low dropout voltage, for linear regulators. The control for the regulators is referenced to ground rather than a relatively noisy power supply terminal so that the control is substantially free of power supply noise. The pass transistor forms the second transistor of a current mirror mirroring the current from the control. Referencing the control to ground and mirroring the control current to the pass transistor makes the output of the regulator substantially independent of the power supply noise. Furthermore, the current mirror can incorporate a bias control circuit that substantially eliminates power supply induced error currents from the current mirror itself, thus further improving the line regulation. Various embodiments are disclosed.

BRIEF DESCRIPTION OF THE DRAWINGS

The features and advantages of the present invention will become apparent from the following detailed description of the present invention in which.

DETAILED DESCRIPTION

Figure 2:
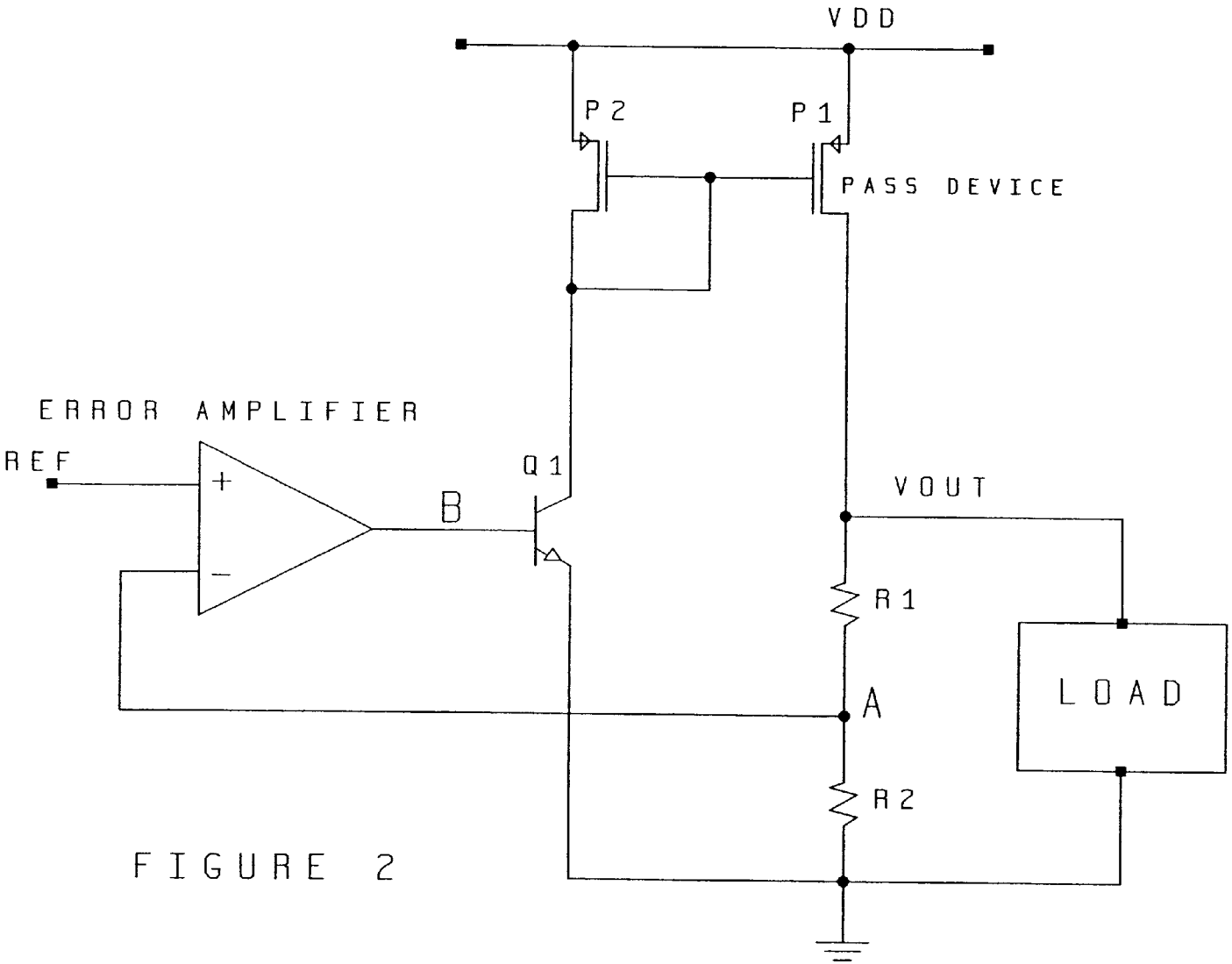
FIG. 2 is a diagram of a first embodiment of the present invention

Now referring to FIG. 2, a diagram of a first embodiment of the present invention low dropout out linear regulator may be seen. As shown therein, instead of using a pass transistor directly controlled by the error amplifier, the error amplifier instead controls, in this case, npn transistor Q1. The npn transistor Q1 in turn controls current to a current mirror formed by the interconnection of transistors P2 and P1, which mirror the collector current of transistor Q1 from transistor P2 to transistor P1 as required to supply current to the load and feedback resistors R1 and R2. Alternatively, the current mirror may be, by way of example, a PNP transistor pair with a common base. In either case, in practice the pass transistor P1 to which the current is mirrored would be dimensioned so as to give some substantial current gain with respect to the current in transistor P2 to achieve high efficiency.

The net effect of the circuit of FIG. 2 is that the current through the pass device P1 is primarily dependent upon the base-emitter voltage on transistor Q1, which is referenced to ground, not the noisy power supply Vdd. Similarly, the mirroring device P2 of the current mirror will establish its gate-source voltage or base-emitter voltage as required to conduct the current of transistor Q1, with that gate-source voltage or base-emitter voltage being directly coupled to the current mirror device P1 to which the current is mirrored. Consequently, the gate voltages or the base voltages of the two devices of the current mirror will generally track the noise on Vdd, with the current mirror accurately mirroring the current of transistor Q1 to the output circuit.

Figure 1:
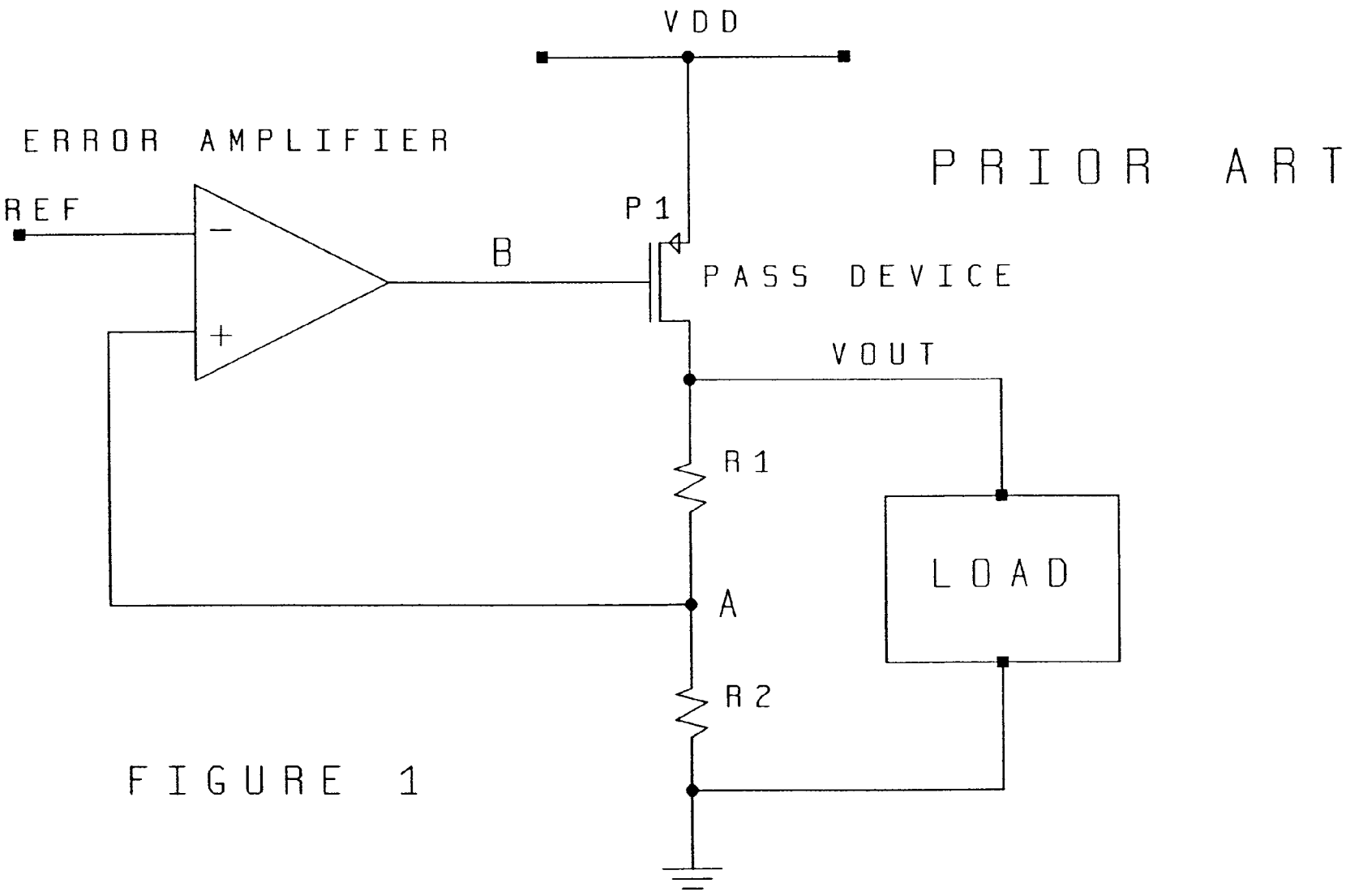
FIG. 1 is a diagram illustrating a typical prior art linear regulator.

Thus in essence the control of transistor Q1 is referenced to ground rather than Vdd. Very little of the power supply noise on Vdd is passed to the output Vout by the operation of the current mirror, all without depending upon the gain and response of the control loop which includes the error amplifier. While the diode connected transistor of the current mirror will in essence couple the noise on Vdd to the collector of transistor Q1, the resulting Early effect variation in the transconductance of transistor Q1 with noise on Vdd will be quite small in comparison to the effect of the noise on Vdd on the pass device of the prior art circuit of FIG. 1.

Figure 3:
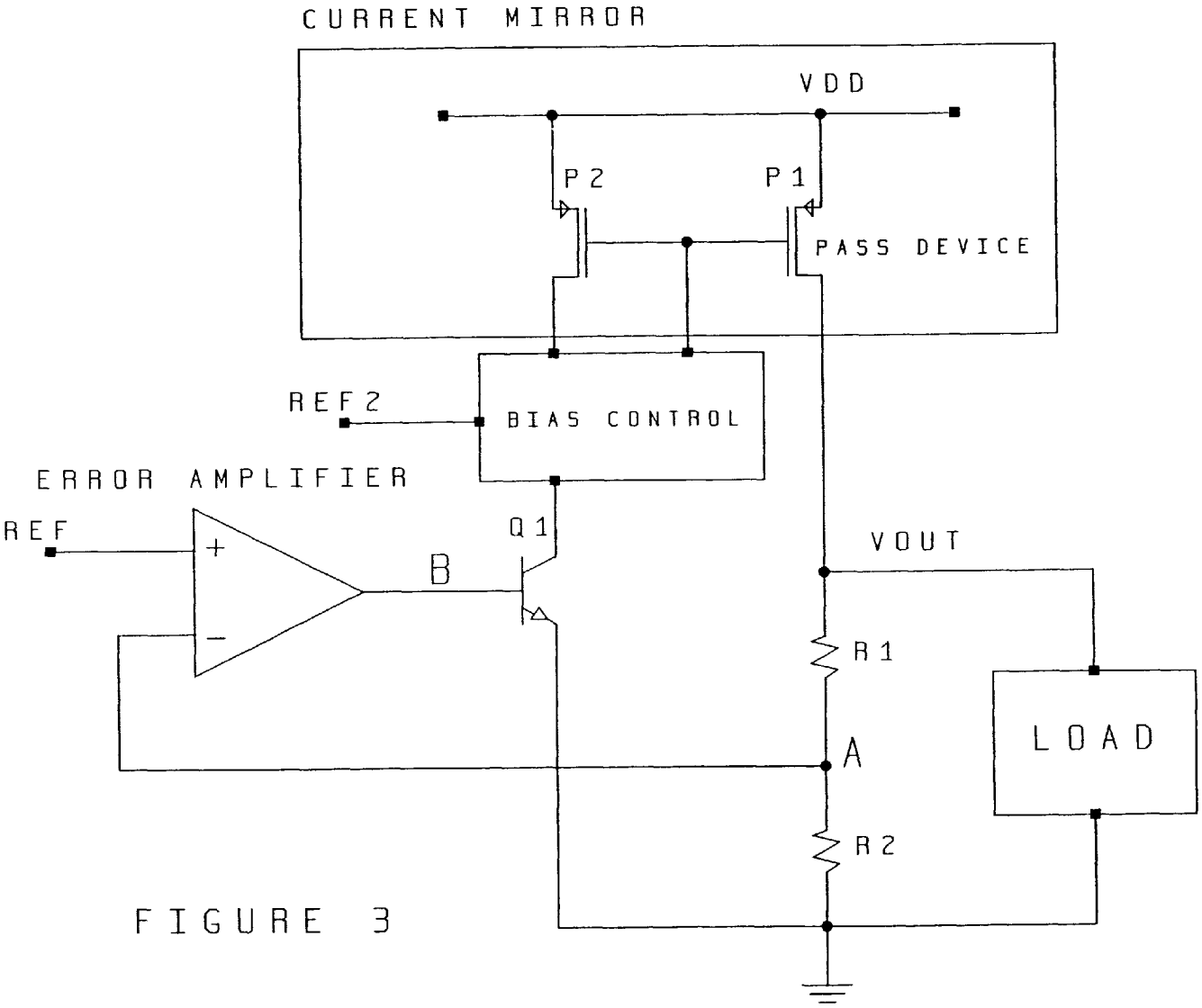
FIG. 3 is a diagram of a further embodiment of the present invention.
Figure 4:
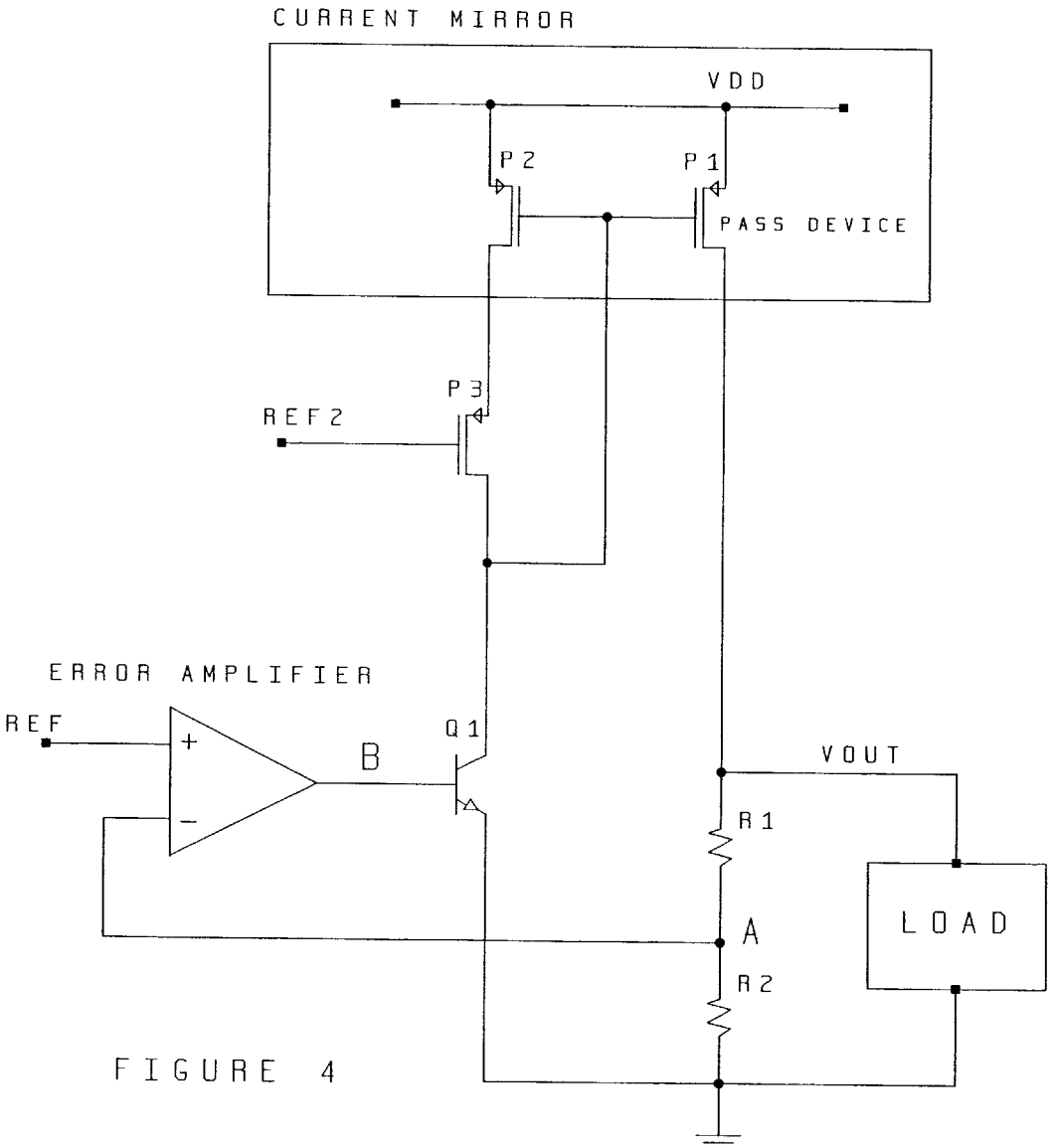
FIG. 4 is a diagram of a still further embodiment of the present invention.

Now referring to FIG. 3, a further improvement in line regulation can be gained by removing the effect of the pass device output impedance on the overall line regulation. Referring to FIG. 2, the gate-drain connection of device P2 implies that, in response to a stimulus on the supply, the drain voltage of device P2 follows the stimulus, whereas the drain voltage of the pass device P1 remains fixed at Vout. This imbalance results in a net error current being mirrored to the output due to the finite output impedance of the pass device P1. This problem can be substantially eliminated by ensuring that the drain voltage of the mirror device P2 is biased to a ground-referred potential REF2. In this way, the current mirror devices see the same bias conditions, independent of the supply voltage. FIGS. 4, 5, 6 and 7 show more detailed embodiments incorporating this aspect of the invention Now referring to FIG. 4, a circuit diagram for one more detailed embodiment of the present invention may be seen. The circuit shown uses a first ground-referenced reference voltage REF and a second ground-referenced reference voltage REF2. The reference voltages may be generated by any of the well known methods for generating reference voltages. The reference voltages usually will be reference voltages independent of temperature, such as by way of example, may be generated by using a band gap reference voltage generator. Alternatively, one or both of the reference voltages may be provided from other circuits on the same chip, or from other circuits off chip. By way of example, the reference voltage REF controls the output voltage VOUT, and might be provided by some external source to provide a means of controlling the regulator responsive to the reference voltage input.

Assume for the moment that the output voltage VOUT has dropped slightly out of regulation, such as may occur with a sudden slight increase in the load on the regulator. This will cause the voltage on node A to drop, causing an increase in voltage at node B and increased base voltage and collector current in transistor Q1. The increased collector current in transistor Q1 will flow through devices P2 and P3, and the common gate voltage of devices P1 and P2 will decrease as required to allow device P2 to conduct the increased current. This ensures the drain current in device P1 increases to mirror this current. Hence the output VOUT rises as required.

Figure 5:
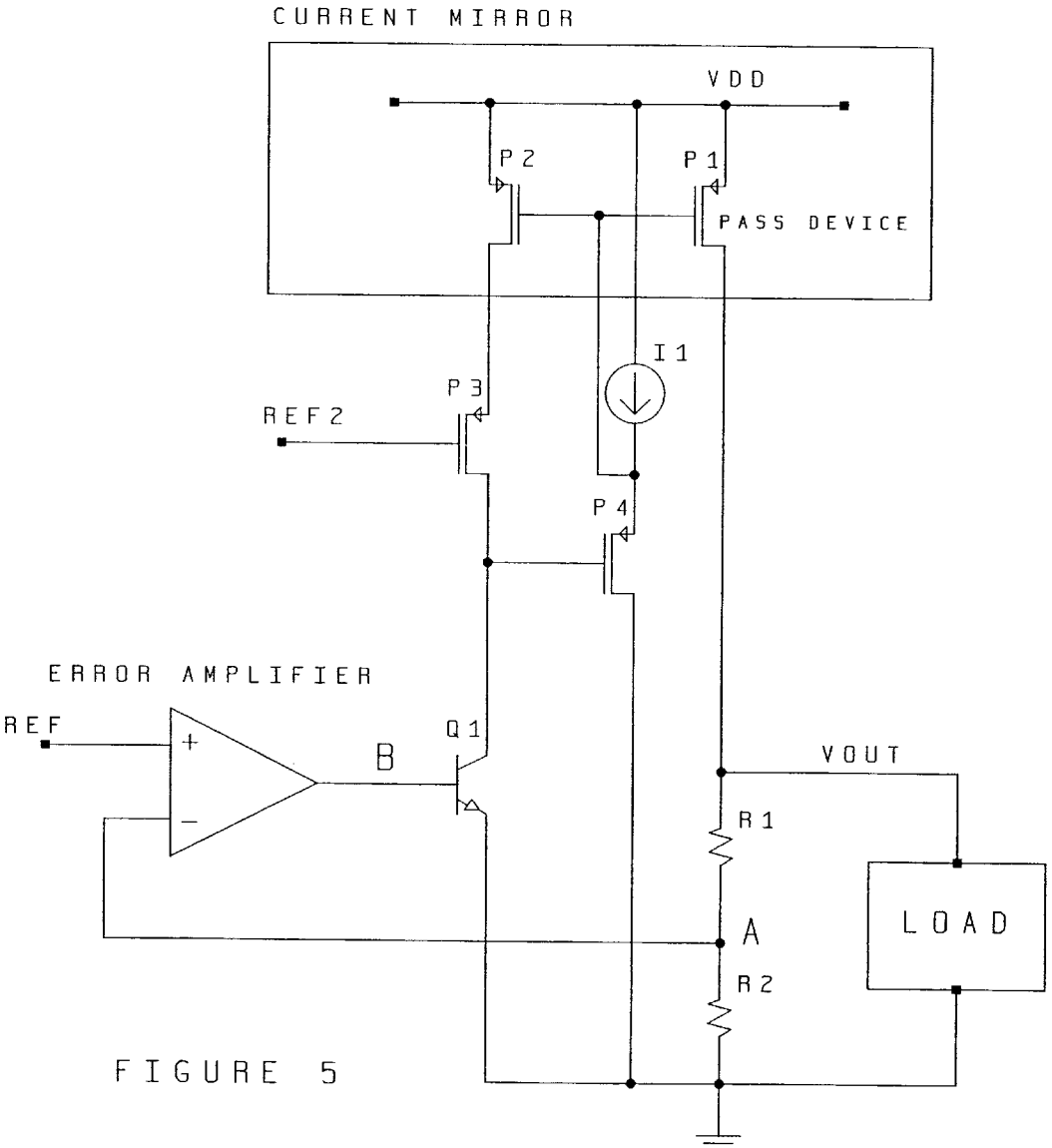
FIG. 5 is a diagram of a still further embodiment of the present invention.

FIG. 5 shows a further embodiment of the invention, whereby a PMOS device P4, configured as a source follower and biased with a current source I1, has been inserted between the drain of device P3 and the common gate connection of devices P1 and P2, thus providing a DC voltage level shift from the common gate of devices P1 and P2 to the drain of device P3. This configuration provides a greater tolerance to variation in the bias conditions of devices P2 and P3 with respect to REF2, such as might be experienced during normal operation of the circuit under extremes of current drawn by the load. In particular, the power supply input voltage Vdd might typically be required to vary by ±+10% under normal operation, whereas REF2, by design, remains fixed. Thus, device P4 has the effect of maintaining devices P2 and P3 in their saturation regions despite such a variation in the power supply input voltage with respect to REF2.

Figure 6:
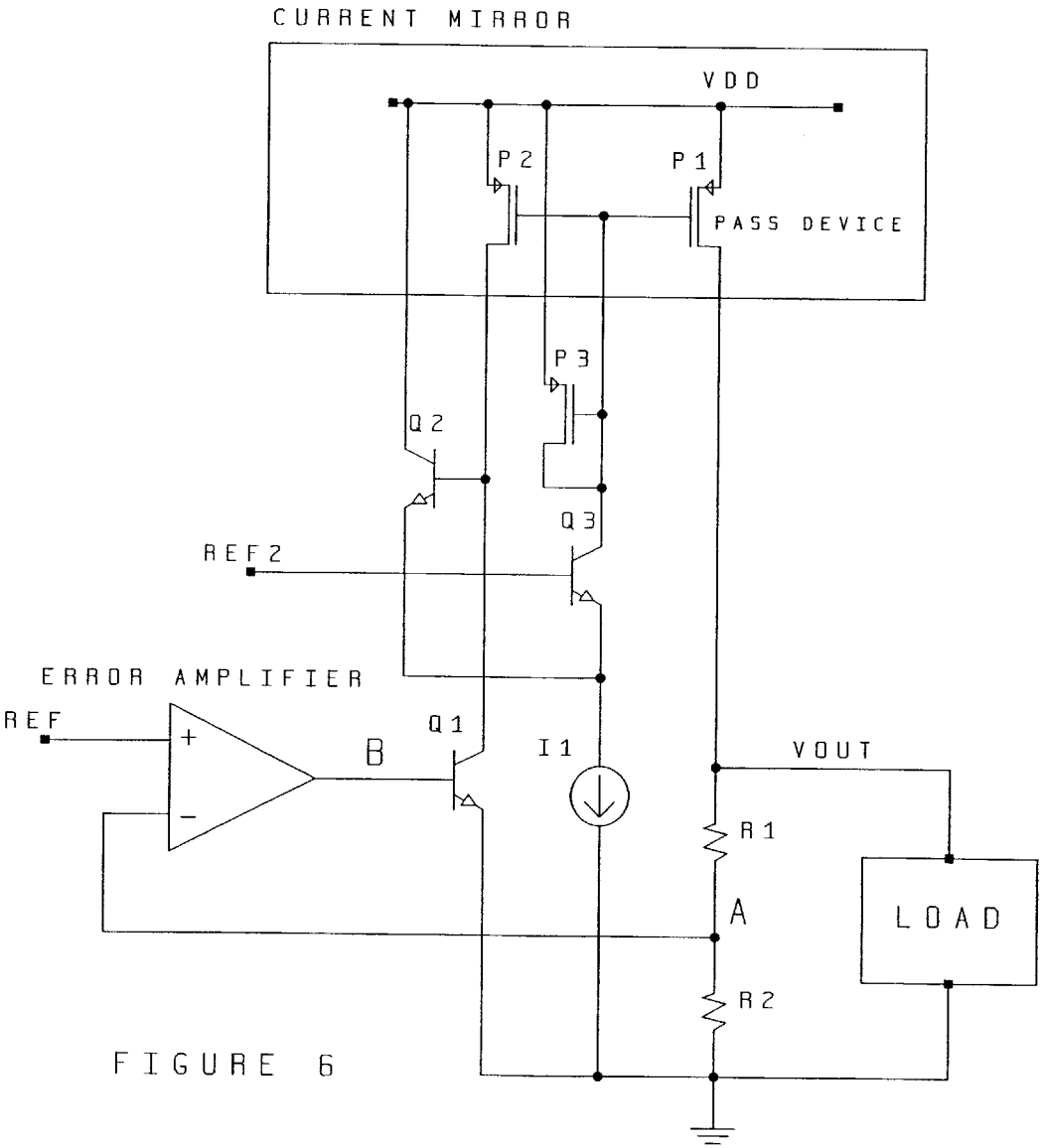
FIG. 6 is a diagram of a still further embodiment of the present invention.

Now referring to FIG. 6, a further embodiment of the invention can be seen. As can be seen in FIG. 6, transistor P3 is diode connected, so the current through transistor P3 will be mirrored to transistor P2, and in a greater magnitude to transistor P1, the pass transistor of the regulator. The current in transistor P2 in turn will equal the current in transistor Q1, as any difference between the current in transistor Q1 and the current mirrored through transistor P2 will be sensed by the equally sized, differential transistor pair Q2 and Q3. This will readjust the portion of the tail current I1 passing through transistor Q3 so as to force the current through transistor Q3 as mirrored through transistor P2 to equal the current in transistor Q1. By way of example, going back to the previous example, if the output voltage VOUT drops slightly, the base voltage of transistor Q1 will increase, increasing the collector current through the transistor. The increase in current through transistor Q1 above that momentarily flowing through transistor in P2 will decrease the voltage on the base of transistor Q2 relative to the reference voltage REF2 on the base of transistor Q3. This increases the portion of the tail current I1 that flows through transistor Q3, with this current then being mirrored back to transistor P2, thus providing the required feedback action to raise the collector voltage of transistor Q1. In this way, the voltage on the base of transistor Q2 will always be substantially equal to the voltage on the base of transistor Q3, namely the voltage REF2. This has the net effect of clamping the collector voltage of transistor Q1 substantially at REF2, rather than being subject to the noise on the power supply Vdd, further reducing the coupling by the power supply noise through the output VOUT on the regulator. Note that the rejection of the noise on Vdd from the output VOUT, as in FIG. 2, does not depend on the feedback of the voltage on node A to the error amplifier for the regulator. Errors in the circuit of FIG. 6 are best balanced if the voltage REF2 is nominally equal to the voltage VOUT.

Figure 7:
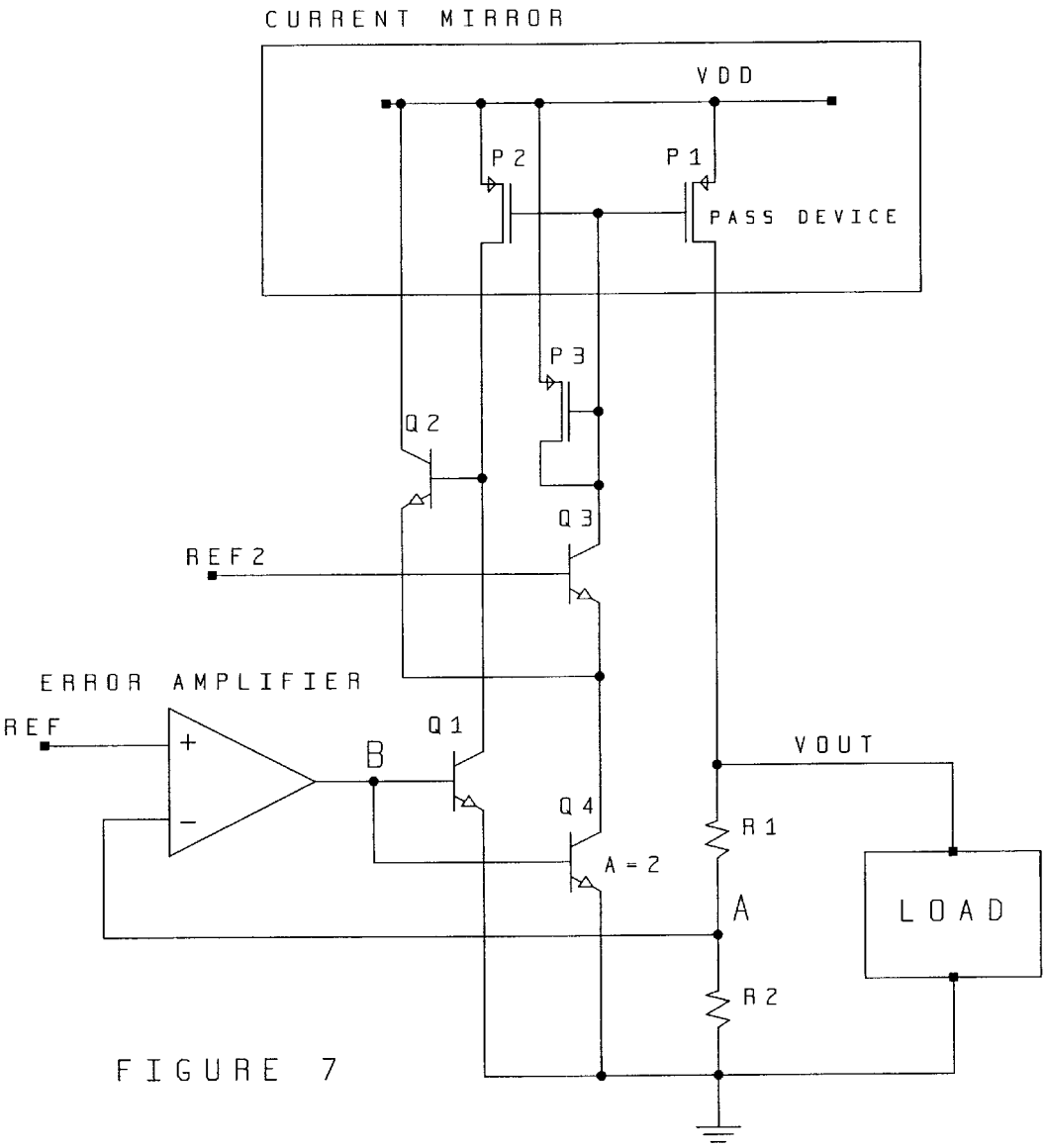
FIG. 7 is a diagram of a still further embodiment of the present invention.

Now referring to FIG. 7, a further embodiment of the invention is illustrated, whereby the fixed tail current source I1 has been replaced by a transistor with its base connected to the base of transistor Q1 and having double the emitter area of transistor Q1. This refinement provides a means whereby the collector currents of transistors Q2 and Q3 can substantially track the collector current in Q1, and hence can provide improved compliance between the base voltage of transistor Q2 and the base voltage of transistor Q3 at the extremes of the load current of the regulator.

The foregoing illustrates exemplary embodiments of the present invention. However while certain specific embodiments of the present invention have been disclosed and described in detail herein, it will be obvious to those skilled in the art that various changes in form and detail may be made therein without departing from the spirit and scope of the invention.

What is claimed is:

1. A linear regulator having a power input, a regulator output and a common connection, comprising:

an error amplifier having a first input coupled to a first reference voltage and a second input coupled to a feedback voltage responsive to the regulator output, the error amplifier providing an error amplifier output responsive to the difference in its inputs;

first, second and third transistors, each having first and second electrodes and a control electrode, the voltage between the control electrode and the first electrode of each transistor controlling the current flow between the first and second electrodes of the respective transistor, the first electrode of the first transistor being coupled to the common connection and the control electrode of the first transistor being coupled to the error amplifier output;

a current mirror coupled to the power input, the second electrode of the first transistor and to the regulator output, the current mirror mirroring the current from the first transistor to the regulator output;

the first electrodes of the second and third transistors being coupled together and to the common connection through a current source, the control electrode of the second transistor being coupled to the second electrode of the first transistor, the control electrode of the third transistor being coupled to a second reference voltage, the second electrode of the second transistor being coupled to the power input and the second electrode of the third transistor being coupled to the power input through a device controlling the current mirror and responsive to the current through the device.

2. The regulator of claim 1 wherein the current source comprises a fourth transistor replicating the current through the first transistor.

3. The regulator of claim 2 wherein the second and third transistors are the same size and the fourth transistor is twice the size of the first transistor.

4. The regulator of claim 2 wherein the second, third and fourth transistors are junction transistors.

5. A linear regulator having a power input, a regulator output and a common connection, comprising:

an error amplifier having a first input coupled to a first reference voltage and a second input coupled to a feedback voltage responsive to the regulator output, the error amplifier providing an error amplifier output responsive to the difference in its inputs;

first, second and third transistors, each having first and second electrodes and a control electrode, the voltage between the control electrode and the first electrode of each transistor controlling the current flow between the first and second electrodes of the respective transistor, the first electrode of the first transistor being coupled to the common connection and the control electrode of the first transistor being coupled to the error amplifier output;

the second and third transistors being coupled as a current mirror, the first electrodes of the second and third transistors being coupled to the power input and the control electrodes of the second and third transistors being coupled together, the second electrode of the second transistor being coupled to the second electrode of the first transistor and the second electrode of the third transistor being coupled to the regulator output, the current mirror mirroring the current from the first transistor to the regulator output;

a bias control coupled between the second electrode of the first transistor and the second electrode of the second transistor, the bias control being responsive to a second reference voltage to set the bias of the second electrode of the second transistor relative to the second reference voltage, the control electrodes of the second and third transistors being coupled to the bias control.

6. The regulator of claim 5 wherein the second reference voltage is referenced to the common connection.

7. The regulator of claim 5 further comprised of a fourth transistor having first and second electrodes and a control electrode, the voltage between the control electrode and the first electrode controlling the current flow between the first and second electrodes, the control electrode of the fourth transistor being coupled to the control electrode of the first transistor, the first electrode of the fourth transistor being coupled to the common connection and the second electrode of the fourth transistor being coupled to the power input through a device controlling the current mirror responsive to the current through the device.

8. The regulator of claim 5 wherein the bias control comprises a fourth transistor having first and second electrodes and a control electrode, the voltage between the control electrode and the first electrode controlling the current flow between the first and second electrodes, the fourth transistor having its first electrode coupled to the second electrode of the second transistor, its second electrode coupled to the second electrode of the first transistor and its control electrode coupled to the second reference voltage, the control electrodes of the second and third transistors being coupled to the second electrode of the fourth transistor.

9. The regulator of claim 8 further comprised of a current source and a fifth transistor, the fifth transistor having first and second electrodes and a control electrode, the voltage between the control electrode and the first electrode controlling the current flow between the first and second electrodes, the current source being coupled between the power input and the first electrode of the fifth transistor, the second electrode of the fifth transistor being coupled to the common connection, the control electrodes of the second and third transistors being coupled to the second electrode of the fourth transistor as a result of the control electrodes of the second and third transistors being coupled to the first electrode of the fifth transistor and the control electrode of the fifth transistor being coupled to the second electrode of the fourth transistor.

10. A linear regulator having a power input, a regulator output and a common connection, comprising:

an error amplifier having a first input coupled to a first reference voltage and a second input coupled to a feedback voltage responsive to the regulator output, the error amplifier providing an error amplifier output responsive to the difference in the error amplifier inputs;

a first current source coupled to the common connection and having a control electrode coupled to the error amplifier output to control the current provided by the first current source responsive to the voltage between the control electrode and the common connection; and, a current mirror coupled to the power input, the first current source and to the regulator output, the current mirror mirroring the current from the first current source to the regulator output;

a differential amplifier amplifying the difference between the voltage provided by the first current source to the current mirror and a voltage referenced to the common connection, the differential amplifier having an output controlling the current mirror.

11. The regulator of claim 10 wherein the current mirror is a MOS transistor current mirror.

12. The regulator of claim 10 further comprising a voltage divider coupled between the regulator output and the common connection, the feedback voltage being taken from the voltage divider.

13. The regulator of claim 10 wherein the differential amplifier has an output controlling the current mirror by controlling the current through a device mirroring the current through the device to the current mirror.

14. The regulator of claim 13 wherein the differential amplifier has a tail current replicating the current of the first current source.

15. The regulator of claim 13 wherein the differential amplifier has a tail current replicating the current of the first current source in the ratio of 2 to 1.

16. The regulator of claim 15 wherein the differential amplifier is a junction transistor differential amplifier.

17. A linear regulator having a power input, a regulator output and a common connection, comprising:

an error amplifier having a first input coupled to a first reference voltage and a second input coupled to a feedback voltage responsive to the regulator output, the error amplifier providing an error amplifier output responsive to the difference in the error amplifier inputs;

a first current source coupled to the common connection and having a control electrode coupled to the error amplifier output to control the current provided by the first current source responsive to the voltage between the control electrode and the common connection;

a current mirror coupled to the power input, the first current source and to the regulator output, the current mirror mirroring the current from the first current source to the regulator output; and, a bias control coupled between the first current source and the current mirror, the bias control being responsive to a second reference voltage to set the bias of the current mirror relative to the second reference voltage.

18. The regulator of claim 17 wherein the second reference voltage is referenced to the common connection.

* * * * *